US005809882A

United States Patent [19]

Ruckmann et al.

[11] Patent Number: 5,809,882

[45] Date of Patent: Sep. 22, 1998

[54] COLOR-PRINTING WEB-FED JOBBING ROTARY PRESS

[75] Inventors: Wolfgang Günter Ruckmann, Würzburg; Martin Heinz Schoeps, Güntersleben, both of Germany

[73] Assignee: Koenig & Bauer-Albert Aktiengesellschaft, Wurzburg, Germany

[21] Appl. No.: 702,555

[22] PCT Filed: Mar. 7, 1995

[86] PCT No.: PCT/DE95/00301

§ 371 Date: Nov. 26, 1996

§ 102(e) Date: Nov. 26, 1996

[87] PCT Pub. No.: WO95/24312

PCT Pub. Date: Sep. 14, 1995

[30] Foreign Application Priority Data

Mar. 10, 1994 [DE] Germany ..... 44 08 027.1

[51] Int. Cl.[6] ..... B41F 7/12

[52] U.S. Cl. ..... 101/177

[58] Field of Search ..... 101/181, 179, 101/180, 182, 184, 185, 177, 176, 221, 136, 137, 138, 139, 140

[56] References Cited

U.S. PATENT DOCUMENTS

| | | | |
|---|---|---|---|
| 2,557,381 | 6/1951 | Huebner | 101/180 |
| 3,892,178 | 7/1975 | Staamann . | |
| 4,567,673 | 2/1986 | Bohnensieker | 101/181 X |
| 4,697,515 | 10/1987 | Germann . | |
| 4,831,926 | 5/1989 | Bowman et al. | 101/138 |
| 5,036,763 | 8/1991 | Germann . | |

FOREIGN PATENT DOCUMENTS

| | | |
|---|---|---|
| 0 219 159 | 4/1987 | European Pat. Off. . |
| 0 343 107 | 11/1989 | European Pat. Off. . |
| 0 372 588 | 6/1990 | European Pat. Off. . |
| 0 400 444 | 12/1990 | European Pat. Off. . |
| 2.191.999 | 2/1974 | France . |
| 42 17 576 | 12/1992 | Germany . |
| 502 186 | 3/1971 | Switzerland . |
| 1 288 360 | 9/1972 | United Kingdom . |
| 2 229 140 | 4/1990 | United Kingdom . |

OTHER PUBLICATIONS

Man–Roland Brochure; "Polyman"; Brochure #235 850; Apr. 1990.

*Primary Examiner*—J. Reed Fisher
*Attorney, Agent, or Firm*—Jones, Tullar & Cooper, P.C.

[57] ABSTRACT

A multi-color web-fed rotary printing press is usable for job printing. Several printing devices are arranged as several bridge printing units which are supported by frames, at least one of which is shiftable in a horizontal direction. The bridge printing units are arranged on a lower horizontal plane and a printed web dryer is situated on an upper horizontal plane. The resultant printing press has a reduced overall size.

15 Claims, 4 Drawing Sheets

COLOR-PRINTING WEB-FED JOBBING ROTARY PRESS

FIELD OF THE INVENTION

The present invention relates to a multi-color web-fed rotary printing press for job printing.

DESCRIPTION OF THE PRIOR ART

A multi-color web-fed rotary printing press with eight inking systems for job printing is known from a brochure of MAN-Roland Druckmaschinen AG, (DE), (Brochure No. 235 850 d/4.90.5pd; Polyman of DRUPA 1990), which consists of a roll changer, four printing systems arranged one behind the other, a dryer, a cooling unit, a turning bar arrangement and a folding apparatus in a horizontal arrangement. In this case, the inking systems for the printing units of the printing systems are arranged once below the horizontally extending paper web and once above the paper web This prior art arrangement is depicted in FIG. 6 of the drawings.

GB-A-2 229 140 discloses a multi-color web-fed rotary printing press with several sheet printing systems disposed above one another. A paper web is supplied to the sheet printing systems by a roll changer. Following printing, the web runs through a drying chamber and finally into a folding apparatus.

The great length of the MAN-Roland printing press is disadvantageous in connection with the mentioned prior art multi-color web-fed rotary printing press, as well as are the large expenses for the construction of the press and the increased costs for enclosing space. Moreover, the paper web to be printed must pass over a relatively long distance between the printing points, which can result in registration difficulties. Finally, it is also disadvantageous that the inking systems associated with the printing units at one time have a direction of the ink flow from the top to the bottom and at another time a direction of the ink flow from the bottom to the top, which can lead to different inking conditions.

SUMMARY OF THE INVENTION

It is the object of the present invention to provide a short multicolor web-fed rotary printing press for job printing of approximately the same structural height and with the same output parameters in respect to the prior art, having a plurality of so-called 1/1 printing units.

This object is attained in accordance with the invention by providing a multi-color web-fed rotary printing press for job printing that has several sheet printing devices which are supplied with paper from a roll changer. After the paper web has been printed, it is conveyed to a drying chamber and then to a folding apparatus. The printing system is comprised of several bridge printing units which are separable into left and right printing units that are mounted on left and right frame sections which are movable horizontally with respect to each other. These bridge units are located on a first plane and the drying chamber is located in a second plane situated above the first plane The following advantages in particular are achieved by means of the present invention:

At approximately the same height as the prior devices, the printing press in accordance with the invention has a considerably reduced total length, because of which enormous construction expenses are saved. By means of a shortened configuration of the printing units, which moreover are also disposed on top of each other in a bridge construction, it has become possible to shorten a multi-color web-fed rotary printing press for job printing in a drastic manner. The ink flow in each printing unit always has the same direction, so that the same inking conditions prevail in all printing units. Because of the reduced distance between the printing units, the amounts of waste during start-up and braking operations, for example during printing plate changes, are reduced. Finally, the printing systems can also be employed as additional printing systems or as a printing system for a flying printing plate change (imprinter).

Further than that, because of the rapid exchangeability of the printing and rubber blanket cylinders for each printing unit, it is possible to achieve a good format variability of the printing systems. In the state of rest of the printing systems' a manual change of a finite rubber blanket or of an endless rubber blanket or (sleeve) is possible because of good accessibility of the press. It is also possible to apply the printing plates to the printing cylinders manually or by means of a printing plate changing device. It is also possible to apply endless rubber blankets, or sleeves to the rubber blanket cylinders. This is also possible in the case of a change of the printing plates on the printing cylinder. The printing system in accordance with the present invention also has advantages regarding the structural height of such printing systems in a satellite construction.

BRIEF DESCRIPTION OF THE DRAWINGS

The present invention will be described in greater detail below by means of an exemplary embodiment. Shown in the associated drawings are in.

DETAILED DESCRIPTION OF THE PREFERRED EMBODIMENTS

Figure 1:
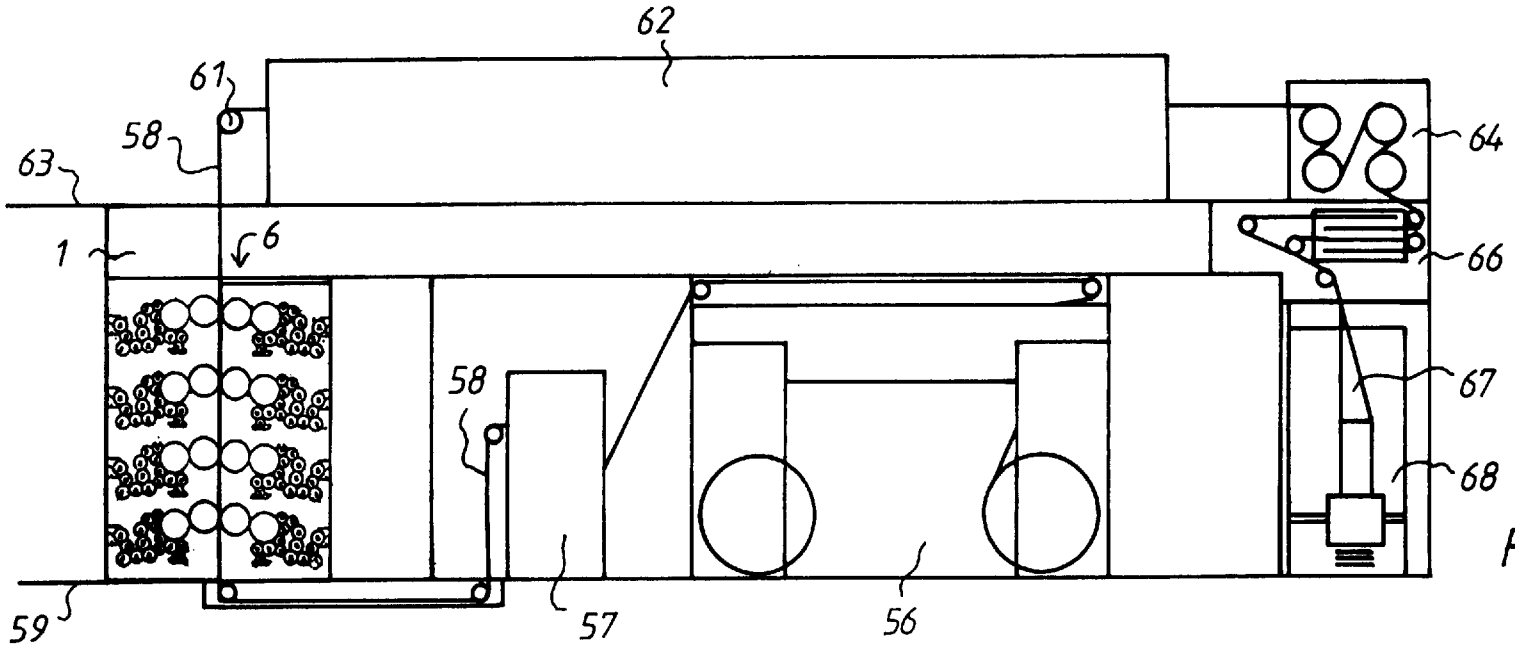
FIG. 1, a schematic lateral view of a printing press in an arrangement in accordance with the present invention, FIG. 2, an arrangement of the printing units shown in FIG. 1 in the rest position, with a displaceable frame element for receiving printing units, FIG. 3 an arrangement of the printing units shown in FIG. 1 in the rest position in a further embodiment with two displaceable frame elements for receiving portions of printing units, FIG. 4, an enlarged representation of a printing unit 4 of FIG. 2 with a conventional inking and dampening system, FIG. 5, an enlarged representation of a printing unit 5 of FIG. 3 with an anilox inking system, FIG. 6, a multi-color web-fed rotary printing press for job printing in accordance with the prior art, and FIG. 7, a multi-color web-fed rotary printing press for job printing in accordance with the invention on a scale for comparison with the prior art in accordance with FIG. 6.
Figure 2:
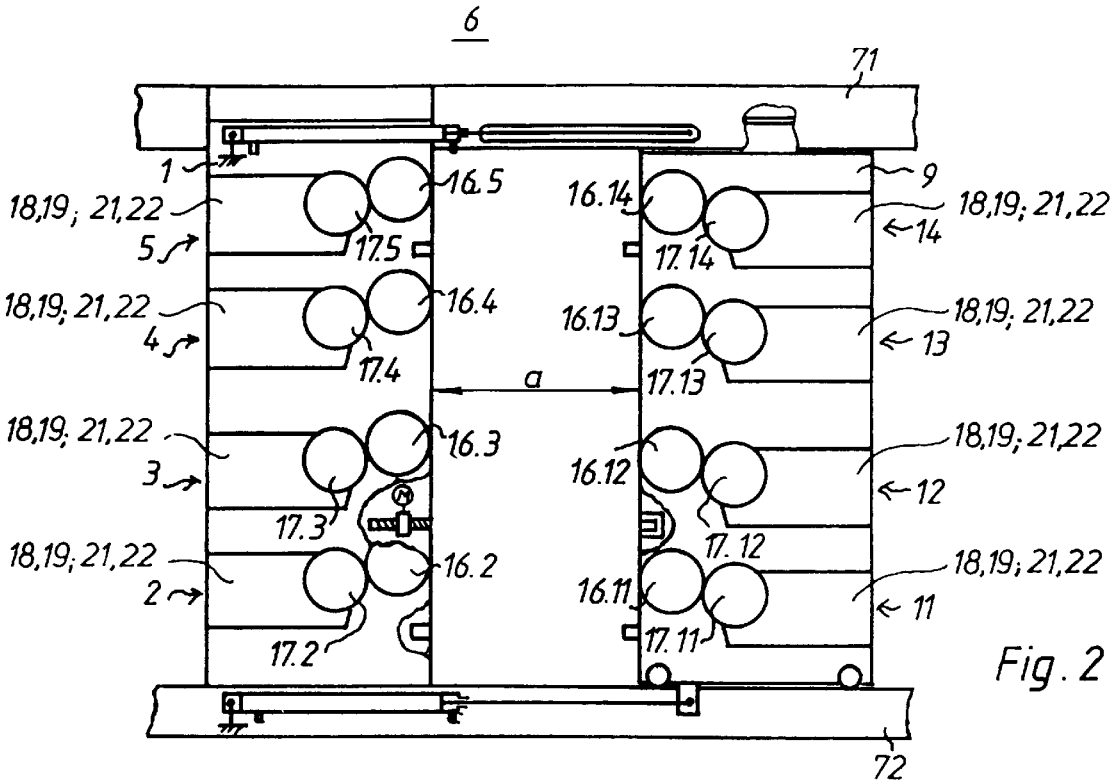
Figure 3:
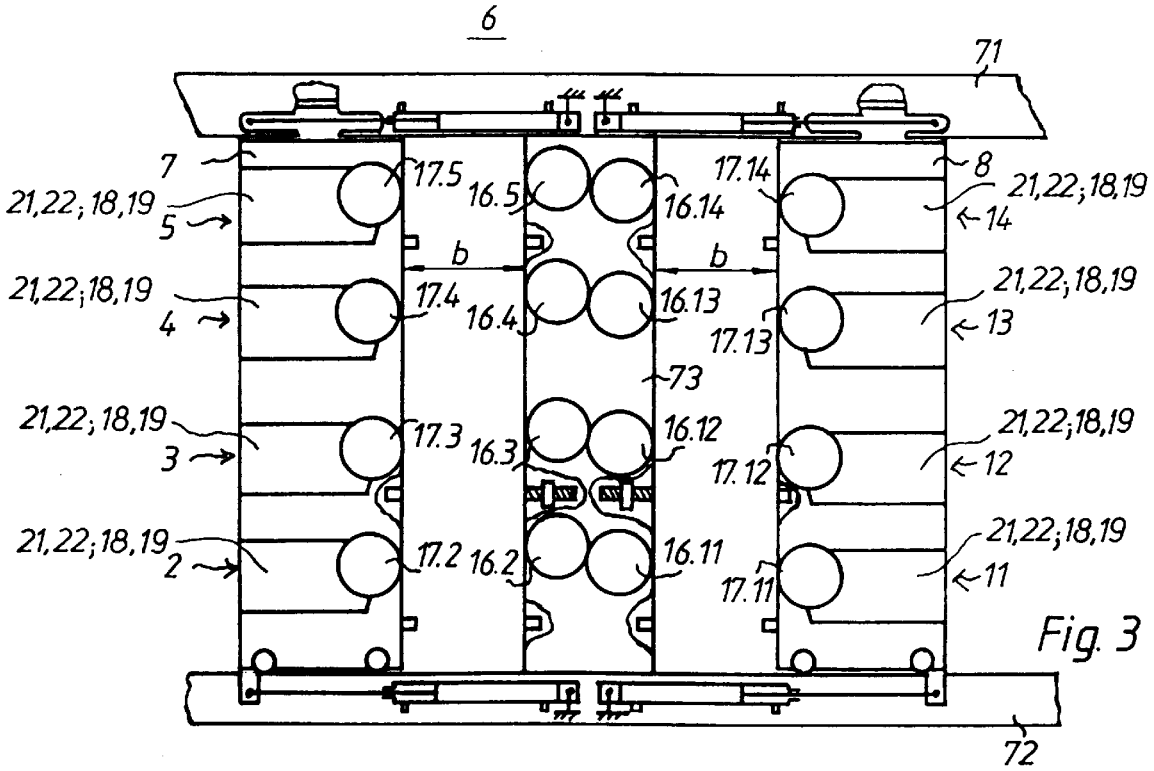
Figure 4:
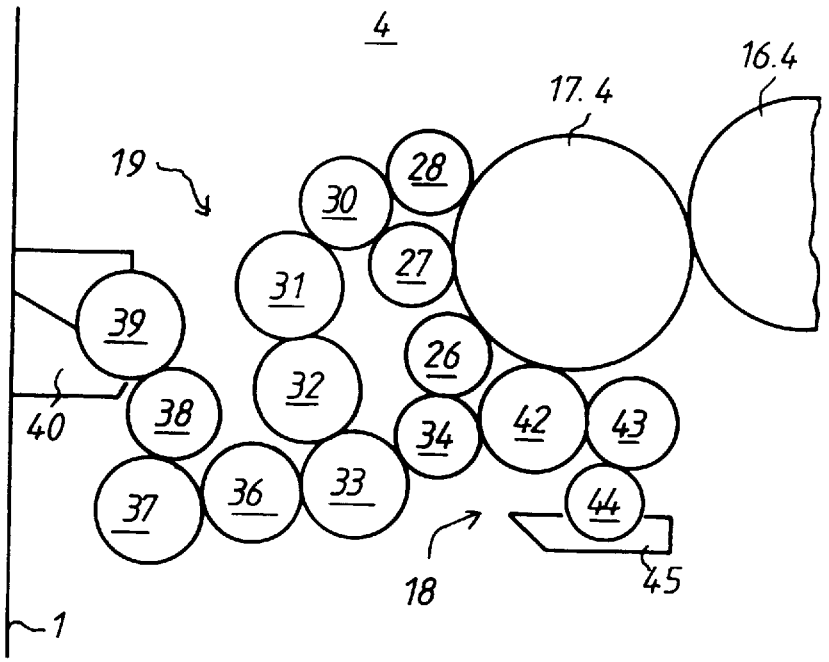
Figure 5:
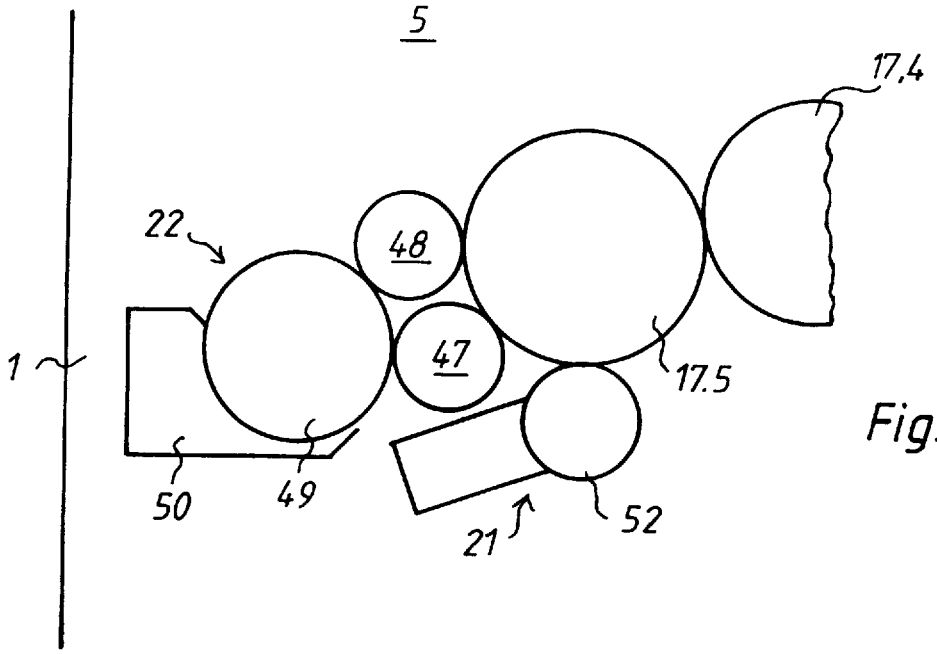
Figure 6:
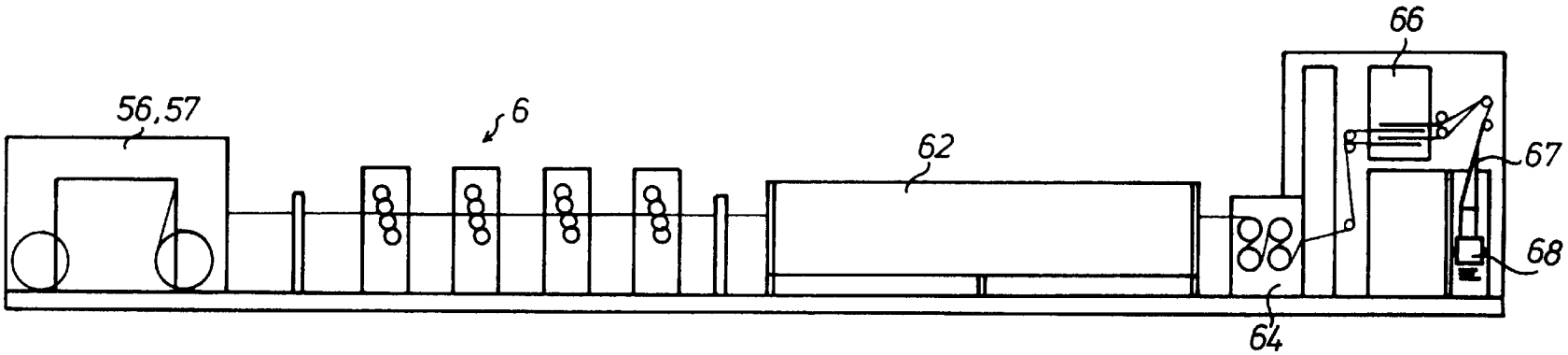
Figure 7:
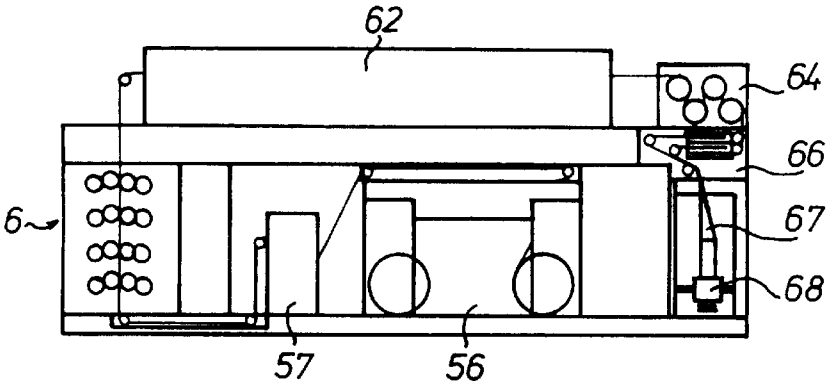

Between an upper support 71 and a lower support 72 as seen in FIGS. 2 and 3, of a multi-color web-fed rotary printing press for job printing which is shown generally in FIGS. 1 and 7, a number of multi-printing units, identified as a whole by 6, is shown in a first horizontal plane 59. This group of printing units consists of printing units 2 to 5 and 11 to 14. These printing units 2 to 5 and 11 to 14, respectively, have rubber blanket cylinders 16.2 to 16.5 and 16.11 to 16.14, which are each respectively arranged in a bridge printing unit 2–11, 3–12, 4–13, 5–14 blanket to blanket. A printing cylinder 17.2 to 17.5 and 17.11 to 17.14 is associated with each rubber blanket cylinder 16.2 to 16.5 and 16.11 to 16.14. A dampening system 18 and a conventional inking system 19 can be associated with each printing cylinder as is shown in FIG. 4. It is also possible to associate respectively spray dampening systems 21 and anilox short printing systems 22 to each printing cylinder 17.2 to 17.5 and 17.11 to 17.14 as depicted in FIG. 5. The bridge printing units 2–11, 3–12, 4–13, 5–14 can be symmetrically separated vertically and at least one half of the bridge printing units 11 to 14 is disposed on a movable or shiftable frame 9 which is displaceable between the supports 71, 72, because of which maintenance work can be performed easier as shown in FIG. 2. A left frame element 1 can be arranged fixed in place on a support, and a right frame element 9 can be disposed, displaceable on rollers, as far as a distance "a" to assure accessibility.

In accordance with a further preferred embodiment, it is possible to seat all rubber blanket cylinders 16.2 to 16.5 and 16.11 to 16.14 stationary in an element 73, which is fixed in place on a support and which is located centrally between the two vertically spaced supports 71, 72, wherein the rubber blanket cylinders touch each other, minus the thickness of a paper web 58, and the printing cylinders 17.2 to 17.5 of the printing units 2 to 5, as well as the respectively associated spray dampening systems 21 and anilox short inking systems 22, are disposed on a left, horizontally displaceable frame element 7. Also, the printing cylinders 17.11 to 17.14 of the printing units 11 to 14, as well as the respectively associated spray dampening systems 21 and anilox short inking systems 22, are together arranged, horizontally displaceable, on a right horizontally displaceable frame element 8, all as may be seen in FIG. 3. The frame elements 7, 8, 9 are displaceable on rollers, and are shifted by means of double-acting work cylinders. The frame elements 7 to 9 are guided with their tops in the support 71. In both embodiments depicted in FIGS. 2 and 3, either inking and dampening systems 18, 19 in conventional construction, or anilox short inking systems 22 or spray dampening systems 21 can be embodied. In the state of rest of the printing unit, the frame elements 7 and 8 are at a distance "b" from the center piece 73 which is fixed in place on the support. The distance "b" as well as the distance "a" are generally at least equal to the (width of a person to facilitate access by a person to the various press components.

The conventional inking system 19, as seen in FIG. 4 consists of three ink application rollers 26 to 28 resting against the printing cylinder 17.4, whose uppermost ink application roller 28 is, in turn, in contact via three ink transfer rollers 30, 31, 32 and two ink distribution rollers 33, 34 with the ink application roller 26 resting against the printing cylinder 17.4. The lower ink distribution cylinder 33 is connected via an ink transfer roller 36 and an ink distribution roller 37 and a lifting roller 38 with an ink ductor 39 of an ink trough 40. A moisture application roller 42 of the dampening system 18 resting against the printing cylinder 17.4 is connected via a moisture transfer roller 43 with a dampening ductor 44 of a dampening water trough 45.

An anilox short inking system 22 is shown in FIG. 5 and consists of one or two ink application rollers 47, 48 resting against the printing cylinder 17.5, which are, in turn, connected with an ink trough 50 via an inking roller 49. A known chamber doctor blade and an ink collecting trough can be employed in place of an ink trough 50. A dampening system 21, if desired to be embodied as a spray dampening system, can consist of a dampening agent application roller 52 resting against the printing cylinder 17.5, and a known spraying device 53 (FIG. 5).

A paper web 58, running from a roll changer 56 via a draw-in system 57, as seen in FIGS. 1 and 7, is supplied to the multi-printing systems 6 disposed on top of each other. The roll changer 56 and the draw-in system 57 consist of known devices and are located on the same, horizontally extending first plane 59 as are the number of multi-printing units 6. After the paper web 58, for example printed 4/4, has left the multi-printing systems 6 in a vertical direction, it is conducted, for example contactless, via a paper guide roller 61 to a hot air dryer 62, which is located in a horizontal direction in a second plane 63 above the supports 71, 72, wherein the second horizontal plane 63 is located above the first horizontal plane 59. A hot air dryer 62 extends above the roll changer 56 and the draw-in system 57 and also partially above the multi-printing systems 6, but at least above the roll changer 56. Viewed in the running direction of the paper web 58, a known cooling roller unit 64 follows the hot air dryer 62 and is located in the second plane 63, and a turning bar superstructure 66 is disposed underneath it, through which the paper web 58 runs before it is supplied, via a known draw-in funnel unit 67, to a known folding apparatus 68 with a product delivery device, which is located in the first plane 59 on the side of the roll changer 56 facing away from the draw-in system. In this way, a reduced overall structural length is achieved with the same structural height of the multi-color web-fed rotary printing press for job printing, wherein 4/4 printing is made possible and it is also possible to operate in the "imprinter" mode. The rubber blanket and printing cylinders are easily accessible for maintenance work as well as for accomplishment of a manual change of the rubber blanket dressings or printing plates. Automatic changing of the printing plates can also take place with the aid of known printing plate changing devices. It is also possible to change a printing forme by means of an exposure and clearing unit without having to remove the printing forme from the press in the process. It is moreover also possible to use printing cylinders or rubber blanket cylinders with changed diameters in the configuration shown in FIG. 3, wherein the seating units for the journals of the cylinders must be embodied to be changeable. When using a known device, for example DE 35 00 319 A1, the cylinders can also be clamped on one side, so that cylinders still present in the printing press can be provided with continuous dressings rubber blanket or print dressing.

While preferred embodiments of a color-printing web-fed jobbing rotary press in accordance with the present invention have been set forth fully and completely hereinabove, it will be apparent to one of skill in the art that a number of changes in, for example, the type of web being printed, the drive arrangement for the press units, the type of inks used and the like may be made without departing from the true spirit and scope of the present invention which is accordingly to be limited only by the following claims.

We claim:

1. A multi-color web-fed rotary printing press usable for job printing comprising:

a printing system disposed at a first plane, said printing system including a plurality of bridge printing units disposed above each other, each of said plurality of bridge printing units being separable into first and second sections, said first section of each of said bridge printing units having a first printing cylinder and a first rubber blanket cylinder, said second section of each of said bridge printing units having a second printing cylinder and a second rubber blanket cylinder, said first and second blanket cylinders in each of said bridge printing units being engageable with each other to print a web passing vertically therebetween;

a first frame section, said first sections of said plurality of said bridge printing units being mounted on said first frame section;

a second frame section, said second sections of said plurality of said bridge printing units being mounted on said second frame section;

means for moving at least one of said first and second frame sections in said first plane with respect to the other of said first and second frame sections so that said first and second frame sections can be separated by a horizontal distance from each other to separate said first and second blanket cylinders in said plurality of bridge printing units from each other;

a roll changer for supplying a paper web to said printing system, said roll changer being disposed at said first plane; and a drying chamber for receiving a printed web from said printing system, said drying chamber being disposed above said roll changer and in a second plane above said first plane.

2. The printing press of claim 1 wherein one of said first and second frame sections is fixed in place.

3. The printing press of claim 1 further including means for locking said first and second frame sections in an operating position.

4. The printing press of claim 1 further including a cooling roller unit arranged in said second plane.

5. The printing press of claim 1 further including a paper web draw-in system situated adjacent said roll changer.

6. The printing press of claim 5 wherein said drying chamber is disposed above said roll changer and said draw-in system.

7. The printing press of claim 5 wherein said drying chamber is disposed above said roll changer and said draw-in system and at least partially above said printing system.

8. The printing press of claim 1 further including a folding apparatus for receiving a printed web from said drying chamber, said folding apparatus being disposed at said first plane, said roll changer being disposed between said printing system and said folding apparatus.

9. A multi-color web-fed rotary printing press usable for job printing comprising:

a printing system including a plurality of bridge printing units disposed above each other at a first plane, each of said bridge printing units being separable into first, second and third sections, each of said bridge printing units including first and second printing cylinders, first and second blanket cylinders and first and second inking systems;

a first frame section, said first printing cylinders and said first inking systems being mounted on said first frame section;

a second frame section, said second printing cylinders and said second inking systems being mounted on said second frame section;

a third frame section, said first and second blanket cylinders being mounted on said third frame section;

means for supporting said first and second frame sections for movement with respect to said third frame section, said third frame section being situated between said first and second frame sections, said first and second frame sections each being separable by a horizontal spacing distance from said third frame section;

a roll changer for supplying a paper web to said printing system; and a drying chamber for receiving a printed web from said printing system, said drying chamber being disposed in a second plane above said first plane.

10. The printing press of claim 9 further including means for locking said first and second frame sections with said third frame section in an operating position.

11. The printing press of claim 9 further including a cooling roller unit arranged in said second plane.

12. The printing press of claim 9 wherein said drying chamber is disposed above said roll changer.

13. The printing press of claim 9 further including a paper web draw-in system situated adjacent said roll changer.

14. The printing press of claim 13 wherein said drying chamber is disposed above said roll changer and said draw-in system.

15. The printing press of claim 13 wherein said drying chamber is disposed above said roll changer and said draw-in system and at least partially above said printing system.

* * * * *